United States Patent [19]

Lukoschek et al.

[11] Patent Number: 4,474,836

[45] Date of Patent: Oct. 2, 1984

[54] METHOD FOR THE PRODUCTION OF CARPET LINERS

[75] Inventors: Klaus Lukoschek, Reinheim; Manfred Schweizer, Gross-Bieberau; Hans C. Trautmann, Darmstadt, all of Fed. Rep. of Germany

[73] Assignee: Chemiegesellschaft Gundernhausen mbh, Rossdorf, Fed. Rep. of Germany

[21] Appl. No.: 482,152

[22] Filed: Apr. 5, 1983

[30] Foreign Application Priority Data

Apr. 10, 1982 [DE] Fed. Rep. of Germany ..... 3213439

[51] Int. Cl.[3] ..... B05D 3/02

[52] U.S. Cl. ..... 427/389.9; 427/412; 427/428

[58] Field of Search ..... 427/389.9, 412, 428

*Primary Examiner*—Bernard D. Pianalto

*Attorney, Agent, or Firm*—Parmelee, Bollinger & Bramblett

[57] ABSTRACT

A method and apparatus for producing carpet liners successively applies a pre-coating and a heavy coating material to a carpet band to be treated. The pre-coating material, which contains an activated isocyanate-polyol mixture, is applied to the carpet band at a temperature at which the components of the mixture will not react with each other. A heavy coating thermoplastic material is subsequently applied to the carpet band. The heavy coating is applied at a sufficiently high temperature to cause the components of the pre-coating mixture, which already has been applied to the carpet band, to react with each other and form polyurethane. Accordingly, a pre-coating layer of polyurethane is formed simultaneously with the application of the heavy coating material.

14 Claims, 1 Drawing Figure

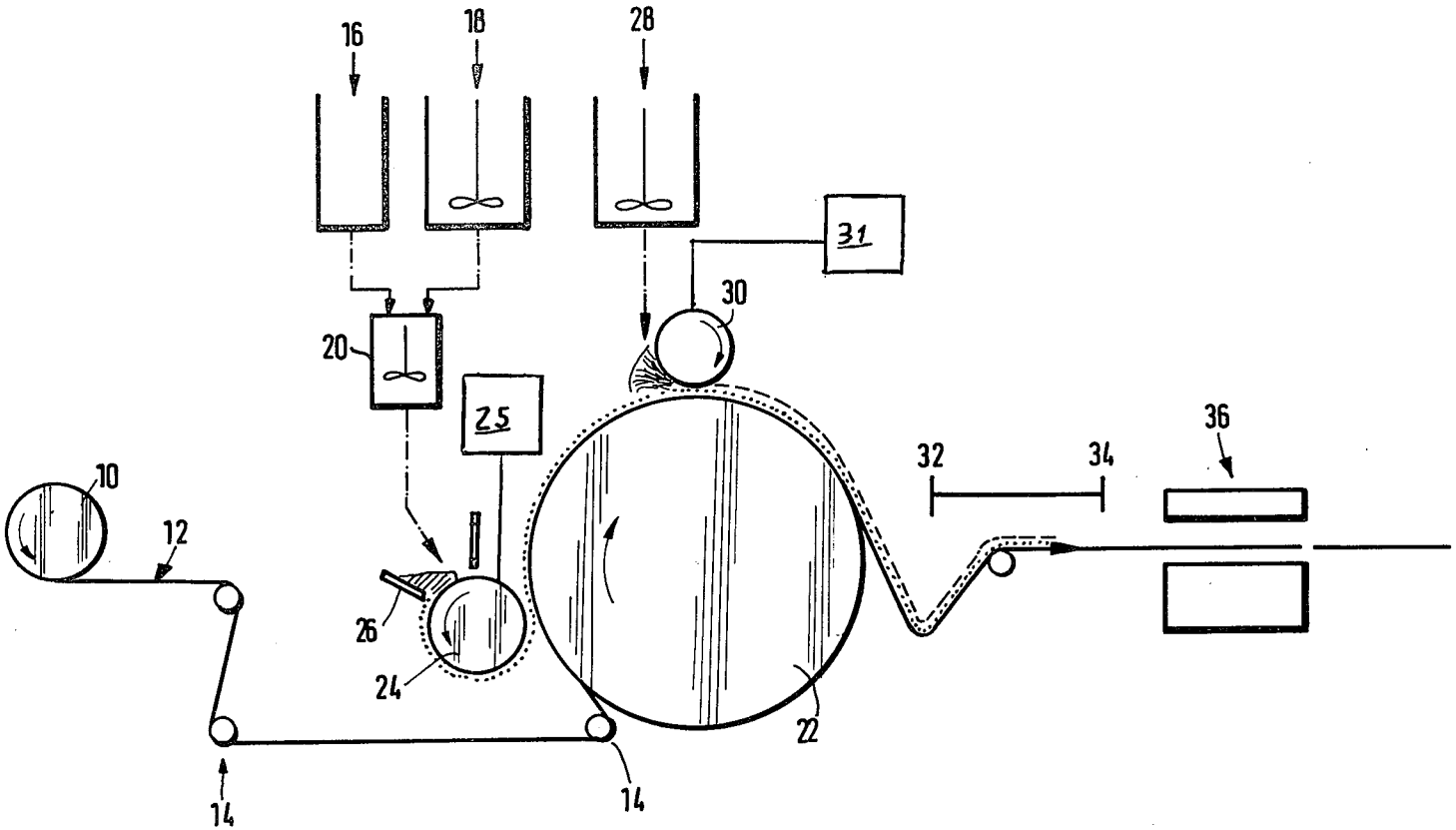
10
12
14
14
16
18
20
22
24
26
28
30
31
32
34
36
25

METHOD FOR THE PRODUCTION OF CARPET LINERS

BACKGROUND OF THE INVENTION

The present invention concerns a method and apparatus for the production of carpet tiles, in which the underside of a textile floor covering, for example a felt or a tufted fabric, is first covered with a preliminary or precoating material and is subsequently covered with a heavy coating. The carpet band produced in this manner then is cut into carpet tiles.

The usual procedure for the production of textile floor coverings, as for example carpet tiles, is to cover a tufted fabric, or felt fabric on its underside with a backing covering that consists of a heavy layer material such as bitumen. It has become evident, however, that the textile fibers easily separate out of such tufted fabric, or felt fabric, particularly when the floor covering is subjected to external loads. For this reason the known procedure has been changed to first cover carpet tiles, whose wear resistance is subjected to great demands, on the underside of the tufted or felt fabric with a pre-coating that soaks into the filaments of the nap and bonds the textile fibers firmly by connecting them with the basic tissue/weave before covering them with a heavy coating. This procedure has become accepted although it entails an additional working step,—the pre-coating—, because a durable carpet tile that can withstand hard use could only be produced in this manner.

The use of filled polyurethane as heavy coating is known. A pre-coating is not required when polyurethane is used as a heavy coating. However, the covering properties, i.e. optimum adaptability and conformability and good adherence to the floor, and the form stability of carpet tiles produced in this manner is not satisfactory. Additionally, polyurethane is expensive. Accordingly, hot melt masses based on atactic polypropylene or bitumen are used almost exclusively for the heavy coatings of carpet tiles where a pre-coating material is required.

It is the object of the present invention to provide a method and apparatus for the production of a carpet tile, which simplifies the known methods that use a pre-coating and a subsequent application of a hot melt heavy coating, and which enables the manufacture of carpet bands for tiles in one production step at a low cost.

SUMMARY OF THE INVENTION

The present method and apparatus solve the aforementioned problems by the use of an activated isocyanate-polyol mixture, including filler if necessary, as a pre-coating. The mixture does not react to form polyurethane at temperatures near room temperature. A thermoplastic material is used as heavy coating, and the pre-coating and the heavy coating are applied successively to a carpet band traveling on the same transport drum roller. A pre-coating roller and the activated isocyanate-polyol mixture are kept at a temperature that is between the dew point of the ambient environment of the system and a temperature at which no reaction takes place between the isocyanate and the polyol. The heavy coating material and a heavy coating roller-applicator are kept at a temperature at which the heavy coating material exhibits fluid properties and the activated isocyanate-polyol mixture reacts to form polyurethane. The application of the heavy coating material to the carpet band at an elevated temperature simultaneously results in the formation of a pre-coating layer of polyurethane. The method eliminates the need to form the pre-coating and heavy coating layers in separate stages, and enables both layers to be formed successively while the treated carpet band travels on the same roller transport drum.

BRIEF DESCRIPTION OF THE DRAWINGS

The single drawing FIGURE illustrates an apparatus for performing the improved method of producing carpet tiles suing a single drum rller and associated pre-coating and heavy coating applicators for applying the respective coatings successively to a carpet band transported on the drum roller.

DETAILED DESCRIPTION OF THE PREFERRED EMBODIMENTS

The method of producing carpet liners in accordance with the present invention begins with the application of a pre-coating mixture to a carpet band to be treated. The pre-coating mixture contains isocyanates, polyols and activaters which are maintained and applied to the carpet band at a temperature at which the components do not react with each other, as, for example, at room temperature. The liquid isocyanate-polyol pre-coating mixture penetrates the underside of the carpet band and soaks the ends of the textile fibers located therein. The flow qualities of the isocyanate-polyol mixture remain unimpaired because no reaction of the mixture has yet occurred. Therefore, the pre-coating mixture penetrates the fibers of the carpet band, particularly when the mixture is applied under the pressure of a roller or applicator.

Immediately after the application of the pre-coating, a heavy coating is applied to the carpet band. The heavy coating is thermoplastic, which is applied to the underside of the carpet band at elevated temperatures. The temperature of the thermoplastic to be applied must be adjusted so that the flow quality (viscosity) is sufficient to apply the heavy coating to the underside of a carpet band via a roller-applicator. The temperature of the heavy coating also must be chosen so that the isocyanate-polyol mixture, or pre-coating, which was not capable of reacting at temperatures near the room temperature will, under the influence of the elevated temperature of the heavy coating, react to form polyurethane.

In this manner, hardening (curing) of the pre-coating takes place simultaneously with the application of the heavy coating when the pre-coating and heavy coating are applied successively to a carpet band. Accordingly, separate steps for applying the pre-coating and heavy coating are eliminated, and the successive applications of the two coatings may be performed by use of the same carpet band transporting drum roller.

The process described above enables carpet bands to be manufactured quickly and at low costs. Because both the heavy coating layers can be applied to a carpet band on a single transport roller, no additional production step is required. By selecting appropriate components for the pre-coating and heavy coating materials to be applied, it is possible to control the bending stiffness and properties of the carpet tile produced.

Unlike the known methods for producing carpet tiles using polyurethane as a heavy coating, the presently described method is economical because it uses a less expensive thermoplastic as a heavy coating, which also produces superior covering properties, i.e. optimum adaptability and conformability and good adherence to the floor. The present process is suited to the production of carpet tiles of all floor covering materials made of textile, such as for example tufted fabric, felt fabric, woven or knit fabric.

Preferably, hot-brushable thermoplastics are used for the heavy coating. Included among such thermoplastics are atactic polypropylene, atactic polybutene, bitumen, ethylene-vinyl-acetate-polymers (EVA), polyvinl acetate and so on. Natural rubber, polyethlene, polypropylene, polybutene, poly-iso-butylene, propylene rubber, ethylene-propylene rubbers (EPDM, EPM), as well as mixtures of these mentioned materials, can be used as additives to the thermoplastics employed for the heavy coating material. Atactic polypropylene, atactic polybutene, bitumen as well as mixtures of atactic polypropylene and atactic polybutene, atactic polypropylene and polyethylene, as well as atactic polyproplene and resins, are preferred. Artificial and/or natural resins, such as hydrocarbon resions are suitable for use in the method. Aliphatic hydrocarbon resins or natural resins such as colopony resin are preferable.

The heavy coating can be filled with known fillers and additives, as for example fillers with a density above 2, such as barium sulfate, calcium carbonate, silicon dioxide, slate powder, powdered limestone, quartz sand, and others. Plasticizers, anti oxidizers, colors, and pigments can be used as additives.

In the present method, the heavy coating should be applied to the carpet band at temperatures in the range of 80° C. to 220° C., preferably between 150° C. to 180° C. When mixtures of atactic polypropylene and atactic polybutene are used in the heavy coating the temperature of the heavy coating at application to the carpet band should be between 150° C. to 180° C. When high-molecular weight atactic polypropylene is used, the temperature of the heavy coating may range between 120° and 220° C. during application to the carpet band. When hydrocarbon resins are added to atactic polypropylene, the temperature for application of the heavy coating are generally between about 120° and 180° C. When using bitumen, lower temperatures are needed during application of the heavy coating, as for example, temperatures in the rance of from 80° to 180° C.

When using fillers with the atactic polypropylene, temperatures for application of the heavy coating having a high filler content, as for example, in the range of 50 to 80% by weight, are between about 160° and 200° C. In the case of low filler content, for example less than 50%, the temperature should be between 140° and 160° C.

All isocyanate-polyol mixtures which do not react, to any appreciable extent, to form polyurethane at temperatures near room temperature are suited for pre-coating. The pre-coating mixture should not react to any appreciable extent to form polyurethane in the range of 0° to 100° C., and preferably should not react within the temperature ranges of 10° to 50° C. and 10° to 30° C.

Such isocyanate-polyol mixtures contain as their isocyanate component, for example, dior poly isocyanate, preferably aromatic di-isocyanates, such as 4,4'-diphenyl-methane-di-isocyanate (MDI) or toluylene-di isocyanate (TDI).

The following polyols are used as the polyol components in the pre-coating mixture exployed in the process of the present invention; polyether—and/or polyester-diols or triols, particularly di and/or trifunctional poly ether—and polyester polyols. In addition mono or multi valent alcohols may be present, for example glycol, glycerin.

As the isocyanate-polyol pre-coating mixture must not react at temperatures near room temperature, special activators which allow the components of the pre-coating mixture to react with each other only at higher temperatures are added. Such activators are, for example, thermically activated amine catalysts, which can consist of salts of amines with organic carbonic acids or of complex bound amines. At elevated temperatures, these activator compounds break down and liberate amines which serve as activators. Metal salts or organo-metal compounds also can be used as thermically activated activators. An example of such a compound is nickel—(II)—acetyl-acetonate.

The activators may be added to the reaction mixture having previously been mixed with the polyol component. If desired, the mixture of isocyanate, polyol and activator may contain the same fillers as previously discussed for the heavy coating.

The process for producing carpet tiles described herein, and an apparatus for carrying out that process, will now be described with reference to the drawing FIGURE.

A tufted carpet band (12), consisting of a polyamide material and a polypropylene carrier webbing, rolls off a feeder device (10), over an idler (14), and onto a single transport drum roller (22).

A storage container (16) contains the reagent 4,4'-diphenyl-methane-di isocyanate (Isocyanate content 30% by weight) (MD1), and a storage container (18) contains the corresponding second reaction component, consisting of the 60% trifunctional poly either polyol with an OH number (mg KOH per G) of 35 4% diethylene glycol with a molecular weight of 106.12 1% nickel-acetyl acetonate 35% Calcium carbonate with an average particle size of about 50 um.

The storage chambers 16 and 18 are connected to a mixing chamber 20. Inside the mixing chamber (20) the two reaction components isocyanate and polyol-mixture are premixed in a ratio of 1:7.8 and are applied onto the carpet band received on the drum roller (22) via a pre-coating roller (24). The quantity of pre-coating to be applied to the carpet band is pre-measured with the aid of the applicator blades (26) which are associated with the pre-coating roller (24). The temperature of the reaction components for the polyurethane as well as the reaction mixture at the pre-coating roller and the carrier drum roller are +15° C. The weight of the application for the pre-coating amounts to 350 g/m$^2$.

The pre-coated carpet band is transported on the carrier drum roller (22), which turns in a direction toward a heavy coating-roller-applicator (30). A storage container (28) connected to the heavy coating roller (30) contains a hot melt mass for the heavy coating consisting of: 25% acatic polypropylene; 3.5% hydrocarbon resin and 71.5% crystallized chalk powder (particle size: 50–200 um).

The temperature of hot melt mass is 170° C. With the aid of the heavy-coating roller-applicator (30) which is heated to 180° C., one hot melt is applied onto the pre-coated carpet band from the storage congainer. The weight of the application amounts to 2000 g/m$^2$.

Because of the effect of the elevated temperature of the coating of the carpet band with the hot, heavy coating mass, the reaction of the activated isocyanate-polyol pre-coating mixture and the formation of polyurethane is initiated.

Conventional means such as heating or cooling elements for adjusting the temperature of the applications 24 and 30 are provided. These means are illustrated by blocks 25 and 31 in the drawing.

The carpet band is transported through a cooling sector (32/34) and cooled down to 20° C. With this cooling, the reaction of the isocyanate-polyol mixture is terminated, so that the carpet band can be cut into carpet tiles with a cutter (36).

Carpet tiles produced in the method and apparatus described herein exhibit very good cohesion of the fiber filaments because of the polyurethane pre-coating, as well as a very good dimensional stability.

It is now apparent that the present invention provides an improved, economical method and apparatus for the manufacture of tile carpets, eliminating difficulties inherent in the known methods. The present method simplifies the manufacturing process by applying both a pre-coating layer and a heavy coating layer using the same drum roller. The successive application of both pre-coating and heavy coating to carpet bands on the same drum roller enables the subsequent application of the hotter heavy coating material to cause a desired reaction of the previously applied cooler pre-coating material, thereby forming the pre-coating layer simultaneously with the application of the heavy coating material.

The description of the embodiments of the invention provided herein is intended to be illustrative only and not restrictive of the scope of the invention, that scope being defined by the following claims and all equivalents thereto.

We claim:

1. In a process for producing carpet tiles including the steps of successively applying a pre-coating and a heavy coating to the underside of a textile floor covering and thereafter cutting a band of carpet into carpet tiles, the improvement comprising:

said pre-coating including an activated mixture of isocyanate-polyol which does not react to form polyurethane at temperatures near room temperature;

said heavy coating including a thermoplastic;

maintaining said activated mixture of isocyanate-polyol and a pre-coating applicator at a temperature between the dew point of the ambient environment and a temperature at which no reaction of the isocyanate and the polyol occurs;

maintaining said heavy coating and a heavy coating applicator at a temperature at which said heavy coating possesses fluid properties and at which the isocyanate-polyol mixture of said pre-coating will react to form polyurethane; and applying said pre-coating and said heavy coating successively on a carpet band traveling on the same transporting drum roller.

2. The process according to claim 1 wherein said pre-coating mixture includes a filler.

3. The process according to claim 1, wherein said thermoplastic is a hot-melt mixture.

4. The process according to claim 1 or 3, wherein said heavy coating thermoplastic is atactic polypropylene.

5. The process according to claims 1, 3 or 4 wherein said heavy coating applicator is maintained in the temperature range of 80° C. to 220° C.

6. The process according to claim 5, wherein said heavy coating applicator is maintained in the temperature range of 120° C. to 200° C.

7. The process according to claim 6, wherein said heavy coating applicator is maintained in the temperature range of 150° C. to 180° C.

8. The process according to claims 1, 3 or 4 wherein said pre-coating applicator is maintained in the temperature range of 0° C. to 100° C.

9. The process according to claim 8, wherein said pre-coating applicator is maintained in the temperature range of 0° C. to 30° C.

10. The process according to claim 9, wherein said pre-coating applicator is maintained in the temperature range of 10° C. to 15° C.

11. The process of claim 1 further including the step of rotating said transporting drum roller during said successive application of said pre-coating and said heavy coating to said carpet band received on said transporting drum roller.

12. The process of claim 11 wherein said pre-coating applicator and said heavy coating applicator are rollers mounted proximate to said rotatable transporting drum roller, said process including the step of rotating said pre-coating and heavy coating rollers for applying said pre-coating and said heavy coating successively to said carpet band on said transporting drum roller.

13. The process of claim 12 including the step of selectively adjusting the temperature of said pre-coating roller.

14. The process of claim 12 including the step of selectively adjusting the temperature of said heavy coating roller.

* * * * *